United States Patent [19]

Pei et al.

[11] 3,941,117

[45] Mar. 2, 1976

[54] COOKTOP FOR A GAS-FIRED RANGE

[75] Inventors: Yu K. Pei; Jack J. Tyson, both of Toledo, Ohio

[73] Assignee: Owens-Illinois, Inc., Toledo, Ohio

[22] Filed: Oct. 21, 1974

[21] Appl. No.: 516,376

[52] U.S. Cl. ..... 126/215; 126/39 J

[51] Int. Cl.[2] ..... F24C 3/04

[58] Field of Search..... 126/215, 214 C, 50, 39 H, 126/39 J

[56] References Cited

UNITED STATES PATENTS

| | | | |
|---|---|---|---|
| 2,960,980 | 11/1960 | Williams et al. | 126/39 J |
| 3,773,027 | 11/1973 | Dodd | 126/39 J |

*Primary Examiner*—Edward G. Favors
*Attorney, Agent, or Firm*—J. R. Nelson

[57] ABSTRACT

The invention disclosed is an improvement in a gas-fired range having a burner means supported in a well in the range structure below its top surface. An annular plate of a glass-ceramic including integral, plural, peripheral downturned legs is supported by the stove well in an overlying, spaced relation to the burner means. The glass-ceramic is formed of a crystallized glass having thermal coefficient of expansion in the range of $-12$ to $+12 \times 10^{-7}/C°$ over a temperature 0°–300°C. In its preferred form, the plate is made of a glass-ceramic having a thermal coefficient in the $-5$ to $+5 \times 10^{-7}/C°$ range over 0°–300°C.

4 Claims, 4 Drawing Figures

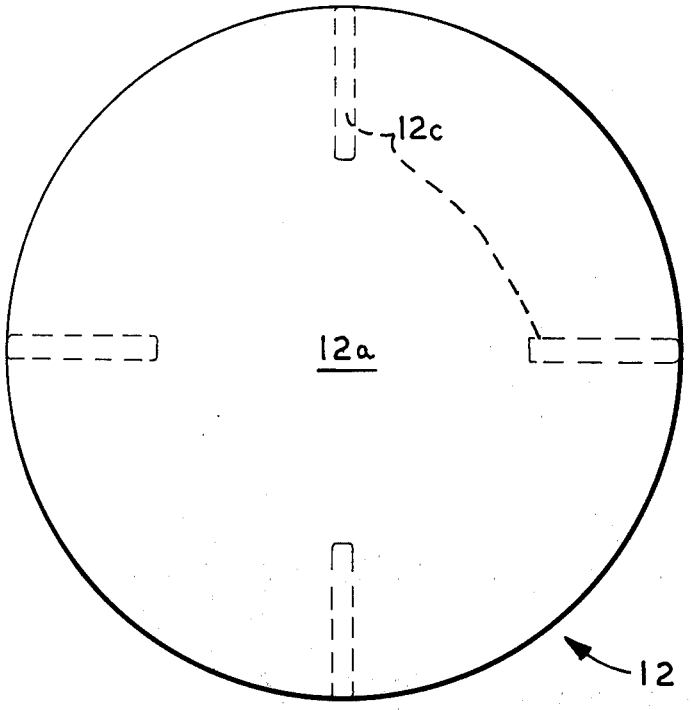
FIG. 2
FIG. 4
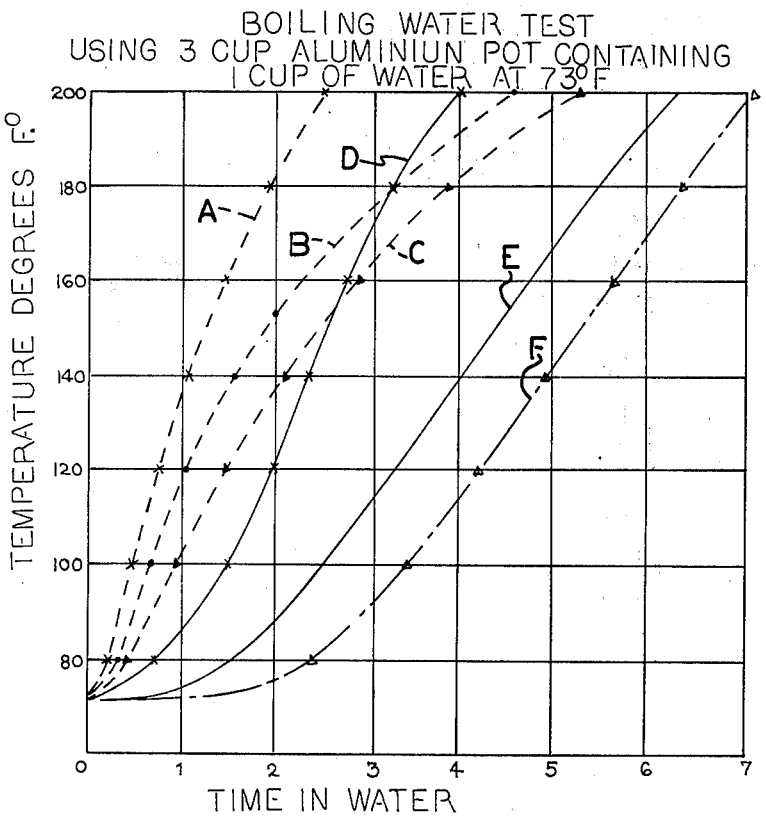

COOKTOP FOR A GAS-FIRED RANGE

BACKGROUND OF THE INVENTION

In a gas-fired range, a metal grate is conventionally employed to support the utensil being heated. The present invention replaces this metal grate in the conventional gas-fired range with a plural-legged, imperforate, solid plate made of glass-ceramic material having a negative to a zero coefficient of thermal expansion. The plate assumes a shape in plan view similar to the metal grate, in that it is preferably circular and larger in diameter than the gas burner annulus. Ventilation space between the range top surface and the glass-ceramic plate perimeter is provided for normal combustion; and the top surface of the plate is raised above the range top surface.

SUMMARY OF THE INVENTION

The present invention relates to glass-ceramic cooktops, and in particular to assemblies in a gas-fired range or the like.

The glass-ceramic cooktop has been adapted to use in the conventional electric range. The aesthetic and cleaning properties of such a cooktop element have been demonstrated commercially as a successful improvement to such a range.

The present invention has for one of its objects the cooktop of a glass-ceramic in a gas-fired range that will operate successfully and be easy to fabricate, operate and clean. Since the present invention provides such a cooktop of simplicity and aesthetic qualities, it does so without the need to alter the combustion system and arrangement of a conventional gas-fired range. The cooktop may be adapted to present day enamel top gas ranges.

BRIEF DESCRIPTION OF THE DRAWINGS

The invention is illustrated in a preferred embodiment illustrated on the drawings, on which:

FIG. 2 is a top plan view of the glass-ceramic plate of the invention to be assembled over a gas burner of the range top of FIG. 1;

FIG. 4 is a graphic illustration showing a comparison of the heating effect of the present invention with other known range tops plotting temperature vs. time in a Boiling Water Test, described herein.

DESCRIPTION OF THE INVENTION

Figure 1:
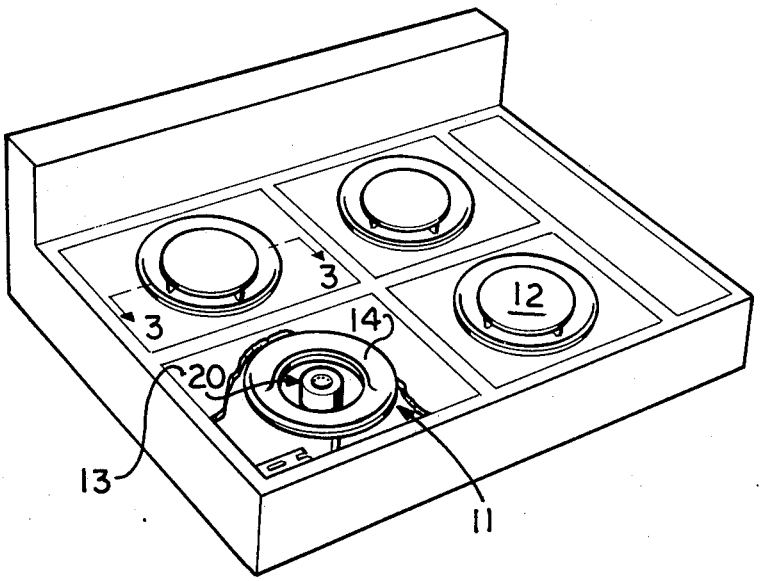
FIG. 1 is a perspective view with parts broken away, of a gas-fired range top constructed with plural burner units embodying the invention.
Figure 3:
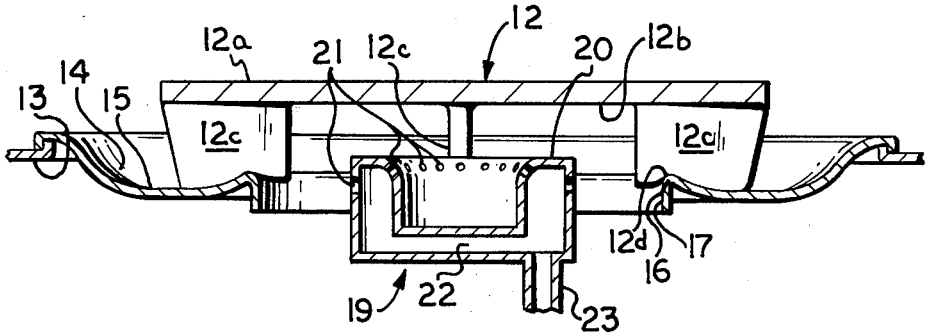
FIG. 3 is a sectional elevational view of one of the burner assemblies of the invention taken along line 3—3 on FIG. 1.

Referring now to FIG. 1, a kitchen gas range top in accordance with the present invention is shown at 10. As is conventional, range 10 has four burner assemblies 11 thereon. The number of burner assemblies is not critical.

On the burner assemblies 11 there is shown a substantially flat and annular plate-like member 12 constructed of a glass-ceramic material having a substantially zero to a negative thermal coefficient of expansion. The glass-ceramic material is substantially transparent to infrared radiation. The member 12 is formed by pressing a quantity of "green" crystallizable glass in a mold, a typical glass composition therefore being given hereinafter. Member 12 has an annular, planar upper surface **12*a* that forms a plate on the order of 3/16 to ⅜ inch thick. Depending from the lower surface 12*b* of member 12 is a plurality of equally-spaced apart legs 12*c* which are in the form of downwardly dependent lugs. As shown on the drawing in dotted outline, FIG. 2, there are 4 such legs 12*c* at the quadrants of a circle. The lower end surface of legs 12*c* are cast to a contoured shape providing a concave segment 12*d*** thereon. The legs should be substantial in dimension to support the load applied in use of the range for cooking and the like.

The stove top construction includes the range enamel top surface 13 and at the burner locations, a well 14 is formed in annular configuration somewhat larger than the plate members 12. The metal well 14 has concaved or dished perimeter pan area 15 to form a ring gutter for collecting spilled material. The pan 15 terminates in an interior annular lip 16 that is turned down in the vertical wall 17 forming an aperture 18 to receive a gas burner unit 19. The gas burner 19 is of usual construction, for example, it comprises a ring tube 20 with fuel ports 21 through the ring and a lower gas chamber 22 connected to the gas supply system providing burner controls and air intake. The gas supply terminates into the burner at pipe 23.

The stove burner ignites the gas and issues flame to the undersurface **12*b* of plate member 12. Legs 12*c* preferably support the plate in the pan 15 at the concave segments 12*d* resting on the annular lip 16 and, thusly, as is preferable, the top surface 12*a* of the glass-ceramic plate 12 is an elevation above the level of stove top 13. The raised plate 12 assures the placement of the cooking utensil over the best heat area, and provides best ventilation for the burner as well as cooling for the plate after use. The annular space over well 15 between the burner pan unit and perimeter of plate 12 provides adequate venting for the burner. The flame of the combustion in burner 19 directs heat onto the plate at lower surface 12*c***.

The plate member 12 is case from a cryatallizable glass, of which the following composition is an example:

TABLE I

EXAMPLES OF SUITABLE CRYSTALLIZABLE GLASS COMPOSITIONS

| Ingredient | Weight Per Cent I | II | III | IV |
|---|---|---|---|---|
| $SiO_2$ | 73.0 | 75.8 | 70.6 | 68.6 |
| $Al_2O_3$ | 17.65 | 16.8 | 19.7 | 21.3 |
| $Li_2O$ | 4.15 | 4.44 | 3.7 | 4.0 |
| ZnO | 1.7 | | 1.7 | |
| $TiO_2$ | 1.4 | 1.84 | 1.7 | 2.0 |
| $ZrO_2$ | 1.6 | 1.17 | 1.5 | 1.6 |
| $Na_2O$ | 0.1 | 0.55 | 0.4 | 0.4 |
| $Cl_2$ | 0.1 | | 0.1 | |
| $Sb_2O_3$ | 0.3 | | 0.5 | 0.3 |
| $K_2O$ | | | 0.2 | 0.2 |
| $F_2$ | | | 0.1 | |
| MgO | | | | 0.1 |

The annealing point of glass composition I is about 1320°F.

The cast or molded part represented at 12 on the drawings is next heat treated in a kiln according to a heat treat schedule that follows:

| Temperature | Time or rate |
|---|---|
| Ambient to 900°F | 100°F per hour |
| Hold 900°F | 2 hours |

-continued

| Temperature | Time or rate |
|---|---|
| 900°F to 1300°F | 100°F per hour |
| 1300°F to 1375°F | 10°F per hour |
| Hold 1375°F | 24 hours |
| 1375°F to 1725°F | 10°F per hour |
| Hold 1725°F | 24 hours |
| 1725°F to 1800°F | 5°F per hour |
| Hold 1800°F | 6 hours |
| 1800°F to 1500°F | 50°F per hour |
| 1500°F to ambient | 150°F per hour |

A second heat treatment schedule is then provided, as follows:

| | |
|---|---|
| Ambient to 1800°F | 100°F per hour |
| 1800°F to 2100°F | 50°F per hour |
| Hold 2100°F | 6 hours |
| 2100°F to 1700°F | 50°F per hour |
| 1700°F to ambient | 300°F per hour |

The final crystallized glass product, the plate member 12, is comprised of a glass-ceramic which has thermal expansion properties on the order of $-12$ to $+12 \times 10^{-7}$ per degree C over the temperature range 0°–300°C. The preferred range of coefficient of thermal expansion properties is $-5$ to $+5 \times 10^{-7}$ per degree C over the temperature range 0°–300°C.

As seen on FIG. 4, the present invention is compared with other forms of range in a "boiling water" test. This test is carried out by comparing the rate of boiling one cup of water at ambient temperature, i.e. 73°F, in a 4¾ inch diameter aluminum pot placed on the stove top burner that is undergoing test. The efficiency data in plotting time vs. temperature is shown in the graph of FIG. 4. The curves of the graph are labelled according to the unit under test, which includes the burner of the present invention.

A = Open flame conventional gas burner
B = The invention using full flame
C = The invention using half flame
D = Electric calrod 5¾ inch dia. burner
E = Electric calrod 4½ inch dia. burner
F = Electric full glass-ceramic range top The manner of supporting the cooktop in the present invention provides very favorable cooling of the surface once the gas burner has been shut down.

Having disclosed an illustrative embodiment of the invention, it is to be understood that the invention is not limited to that precise embodiment and that various changes and modifications may be effected therein by one skilled in the art without departing from the scope or spirit of the invention, as set forth in the appended claims.

We claim:

1. In a gas-fired range, the combination of a gas burner means supported in said range and operable for combustion of a gaseous mixture, a range top surface, the burner means being spaced below said top surface, an annular semi-torroidal concave well support forming an intermediate ring gutter encircling said burner means and terminating at an innermost annular downturned rim flange portion defining an annular lip disposed above the gutter portion, a glass-ceramic plate member comprising an annular plate surface and plural, peripherally spaced, downwardly depending legs on the undersurface of said plate, said plate member and plurality of legs thereon are integral and formed together as a unit from a crystallizable glass material, the lower extremities of said legs each having a contoured lower end surface including a conforming concave notch matching said annular lip of the well support which cooperates with said lip for supporting said plate in stable flat position in an overlying spaced relation to said burner means, said legs maintaining the plate member elevated above and spaced from the range top surface and in overlying spaced relation to said burner means.

2. The combination of claim 1, wherein said plate member has a circular, flat top surface and said plural legs comprise four legs equally spaced apart about the circumference of said plate and disposed radially inwardly along the underside of said plate a substantial extent of the radius of said circular plate.

3. The combination of claim 1 wherein said glass-ceramic material possesses thermal coefficient of expansion in the range of $-12$ to $+12 \times 10^{-7}$ per degree C over a temperature range of 0°–300°C.

4. The combination of claim 3, wherein the thermal coefficient of expansion of said glass-ceramic material is more particularly characterized in the range of $-5$ to $+5 \times 10^{-7}$ per degree C over said temperature range of 0°–300°C.

* * * * *